US007980787B1

(12) United States Patent
Trent et al.

(10) Patent No.: US 7,980,787 B1
(45) **Date of Patent: *Jul. 19, 2011**

(54) DUAL PRESSURE TENSIONER METHOD

(75) Inventors: David Trent, Cypress, TX (US); Robert Magee Shivers, III, Houston, TX (US); Charles C. Trent, San Antonio, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/612,486

(22) Filed: Nov. 4, 2009

(51) Int. Cl.
*E21B 43/01* (2006.01)

(52) U.S. Cl. ..... 405/224.4; 405/223.1; 166/355; 92/85 B

(58) Field of Classification Search ..... 405/224.4, 405/223.1; 166/345, 359, 350, 367, 355; 175/10; 92/151, 142, 81, 168, 110, 85 B
See application file for complete search history.

(56) References Cited

U.S. PATENT DOCUMENTS

| | | | | |
|---|---|---|---|---|
| 6,554,072 | B1 * | 4/2003 | Mournian et al. | 166/355 |
| 6,554,992 | B1 * | 4/2003 | Smith | 205/732 |
| 2008/0210108 | A1 * | 9/2008 | Hahn et al. | 100/269.14 |

* cited by examiner

*Primary Examiner* — Kenneth Thompson
*Assistant Examiner* — Sean Andrish
(74) *Attorney, Agent, or Firm* — Buskop Law Group, PC; Wendy Buskop

(57) ABSTRACT

A method for tensioning for oil and natural gas floating platforms and floating vessels using a plurality of self contained dual pressure cylinders for adjusting simultaneously low and high pressures in low pressure and high pressure channels. The method can be used on a floating structure to dampen the effects of sea waves and wind load between casing from a well and the floating structure.

24 Claims, 14 Drawing Sheets

FIGURE 4A
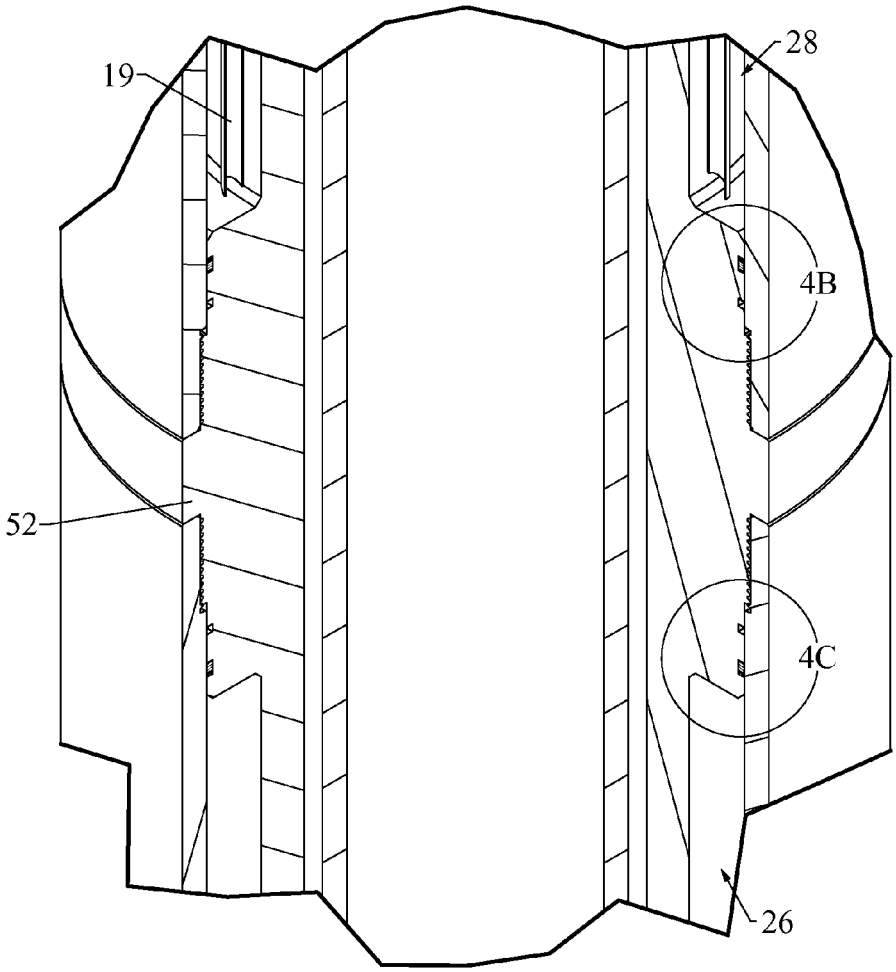
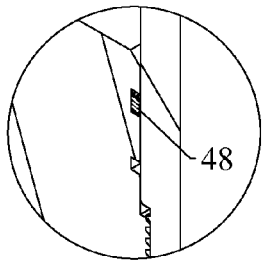
FIGURE 4B
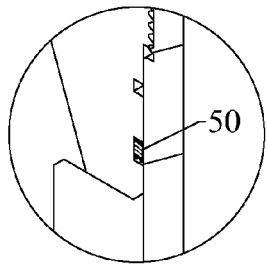
FIGURE 4C

DUAL PRESSURE TENSIONER METHOD

FIELD

The present embodiments generally relate to a dual pressure tensioning method using a tensioner assembly having a plurality of self contained dual pressure cylinders for offshore oil and natural gas floating platforms and drill ships.

BACKGROUND

A need exists for a dual pressure tensioning method using a tensioner system that has groups of individually removable cylinders for continuous operation of the tensioner system for use with a drill ship, a drilling platform, a work over platform or a similar floating oil field device usable in shallow water and deep water, such as water depths of over 20,000 feet.

A need has long existed for a dual pressure tensioning method using a tensioner system for tensioning drilling casing that can properly and safely tension a floating platform in heavy seas, such as in 100 year storms.

A need exists for a dual pressure tensioning method using a tensioner system that has portable, removable, modular, and re-installable dual pressure cylinders that are not co-dependant on other cylinders, and that are able to operate synchronously and simultaneously while being individually removable from the tensioner system.

The present embodiments meet these needs.

BRIEF SUMMARY OF THE INVENTION

N/A

BRIEF DESCRIPTION OF THE DRAWINGS

The detailed description will be better understood in conjunction with the accompanying drawings as follows:

FIGS. 4A-4C show a detailed view of a low pressure elastomeric seal with a low pressure/high pressure separator.

Figure 1A:
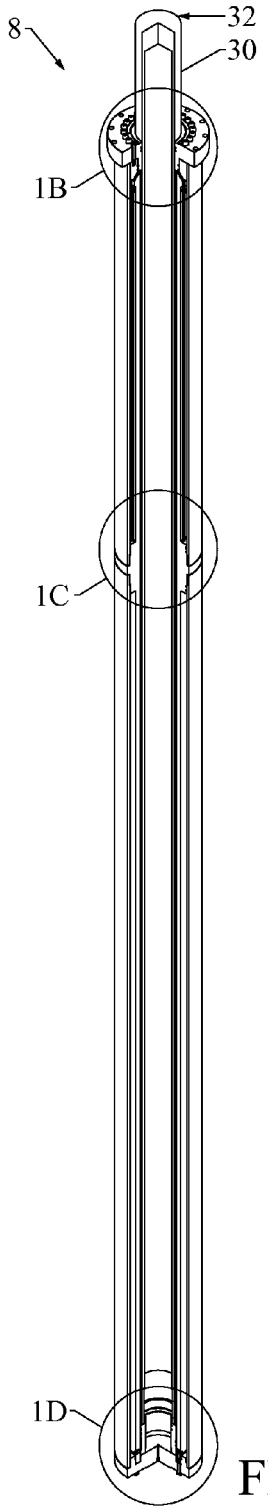
FIGS. 1A-1D show a cut view of a dual pressure cylinder.
Figure 1B:
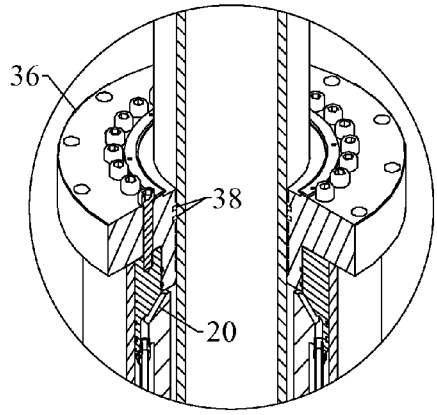
Figure 1C:
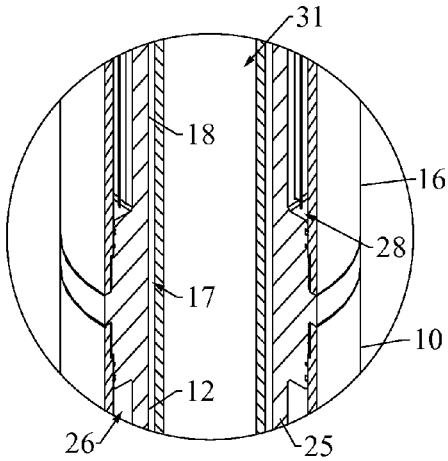
Figure 1D:
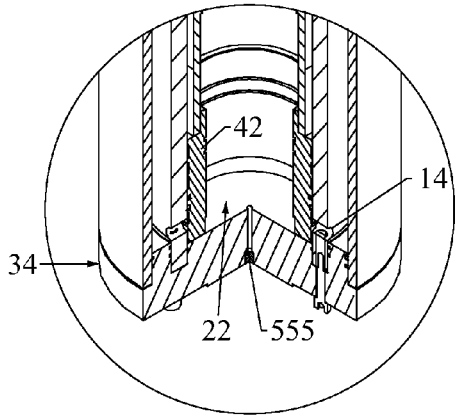

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The tensioner system usable in the method is a dual pressure tensioner system for floating vessels and has a tensioner table with a top side, a bottom side and a plurality of load buckets.

A plurality of dual pressure cylinders are used in the dual pressure tensioner system. Each dual pressure cylinder can connect to a load bucket of the tensioner table. The dual pressure cylinders each provide two different pressures simultaneously.

The dual pressure cylinders, when used in the tensioner system, allow for the monitoring of pressures in each cylinder to ensure safe operation of the tensioner system. During the monitoring of all of the dual pressure cylinders of the tensioner system, each dual pressure cylinder simultaneously remains independent of other dual pressure cylinders. Multiple dual pressure cylinders can be used simultaneously in the same tensioner system. Embodiments of the tensioner system ensure safer operation of tensioner systems.

Embodiments of the method use a tensioner system with dual pressure cylinders that provide longer operation than known systems because the improved tensioner system, as a whole, can continue to operate to provide tensioning during storms, such as 100 year storms, even when one of the dual pressure cylinder malfunctions.

The dual pressure cylinders usable with the method enable easy maintenance of the tensioner system. For example, a single dual pressure cylinder can be replaced while the tensioner system is operating at sea. The tensioner system usable in the method can continue to operate without stopping the entire operation of the tensioner system.

Each dual pressure cylinder can simultaneously provide two different pressures for tensioning in one cylinder. The dual pressure cylinders enable a safer device than cylinders that simply have only high pressure applications.

The dual pressure cylinders can be self contained and can reduce the risk for tensioner maintenance in a splash zone of an offshore platform, as cranes can be lowered and connected to the self contained cylinders and removed without the need of more than one person to disconnect each dual pressure cylinder from the tensioner table. Embodiments of the tensioner system provide a safe work environment on a rig.

Another benefit of embodiments is that fewer parts are needed to operate the tensioner system, as fewer valves are needed to control piping to a plurality of cylinders from a single compressor. The tensioner system does not require pumps or special valving.

Embodiments of the method prevent the need for external piping, valves, and compressed air bottles on a rig. The method does not require plumbing from external bottles. This is beneficial because the lines of plumbing that require external bottles can be damaged in the sea or in a storm if the tensioner system is installed on a floating vessel.

Still another benefit of the method is that no exposed parts are on deck while a hand is working or maintaining a tensioner system.

Embodiments relate to a dual pressure tensioning method using a tensioner system with a self contained dual pressure cylinder system for oil and natural gas floating vessels.

A high pressure outer barrel surrounds a high pressure inner barrel and forms a high pressure gas channel.

A low pressure outer barrel surrounds a low pressure inner barrel and forms a low pressure fluid channel. The low pressure outer barrel adjoins the high pressure outer barrel and the low pressure inner barrel adjoins the high pressure inner barrel.

A high pressure gas port connects to a high pressure gas reservoir, and a low pressure fluid port connects to a low pressure gas reservoir.

A low pressure fluid compression area is connected to the low pressure fluid port.

A moveable hollow rod can slidingly engage the insides of both the high pressure and the low pressure inner barrels. The moveable hollow rod has a first end for engaging a load bucket of the tensioner table The moveable hollow rod can also have a chamber, which can be fluidly connected to the high pressure gas reservoir enabling the moveable hollow rod to support a load.

A dual pressure capture plate with moveable rod seals and moveable rod wear bands seals the moveable hollow rod inside the high pressure and low pressure inner barrels.

A piston fastened to a moveable hollow rod's second end opposite the tensioner system enables each dual pressure cylinder to provide foot strokes from about 6 feet to about 45 feet.

A low pressure/high pressure separator with a low pressure elastomeric seal can be adjacent the low pressure side of the low pressure/high pressure separator, and a high pressure elastomeric seal can be adjacent the high pressure side of the low pressure/high pressure separator, each providing non-deforming separation between the high pressure gas reservoir and the low pressure gas reservoir.

In embodiments, the piston can have a piston body with a plurality of moveable rod wear bands and a plurality of moveable rod seals for sealing between the piston body and the high pressure and low pressure inner barrels.

The piston can include a piston drain port, a piston end cap, and a plurality of piston end cap fasteners holding the piston end cap to the high pressure inner barrel. The piston can include a piston seal groove containing at least one of the piston removable rod seals.

It can be noted that the high pressure gas channels can support a pressure from about 100 psi to about 3600 psi.

The high pressure gas can be an expandable gas such as nitrogen, air, helium, argon, or combinations of these expandable gases.

The low pressure fluid channel can have from about 20 percent to about 70 percent liquid by weight or volume with the remainder of the low pressure fluid channel having a gas.

The gas of the low pressure gas channel can be nitrogen, air, helium, argon, or combinations of those gases flowing over the liquid.

The liquid of the low pressure gas channel can be a liquid glycol, a hydraulic liquid, a mineral based liquid lubricant, a silicon liquid, or a glycol based liquid lubricant. The lubricants can be a white oil, a silicon oil, a mineral oil or combinations thereof.

Embodiments can include a low pressure access port with a low pressure closable fitting in the piston body. The low pressure access port can be in the portion of the piston body closest to the tensioner table.

A high pressure access port with a high pressure closable fitting can also be in the piston body on a top side of the piston, at a point adjacent to the tensioner table.

In embodiments, the high and low pressure access ports can connect to access channels that are not the main channels for the low pressure fluid and the high pressure gas, but are channels that provide access to these main channels, and allow sensors to determine the pressures in the channels.

Embodiments of the dual pressure tensioning method using the tensioner assembly can have the access channels vertically disposed parallel to the axis of a conductor or centralizer of the tensioner system, wherein the high pressure and low pressure fluid channels are angled through the piston body, thereby allowing a larger gas or fluid containment area, providing increased versatility, and providing increased capability as compared to channels that are parallel to the conductor or to the access channels. The access channels can be at an angle from about 20 degrees to about 60 degrees from an axis of the low and high pressure channels and can be used for damping floating platform movement by the tensioner system.

A controller with a controller processor in communication with controller data storage can be used with the access channels. The controller data storage can store preset pressure limits for the low and high pressure gas channels.

A high pressure sensor can be disposed between the high pressure closable fitting and the controller, and the high pressure sensor can be in communication with the controller. The controller can increase or decrease the pressure within the high pressure gas channel based upon preset pressure limits stored within the controller data storage, or based upon user indicated changes.

In embodiments, a low pressure sensor can be disposed between the low pressure closable fitting and the controller, and can be in communication with the controller for increasing or decreasing pressure within the low pressure gas channel based upon preset pressure limits stored in the controller data storage, or based upon user indicated changes. The user indicated changes for the high pressure sensor and low pressure sensor can be variable over 60 minutes time frames, and can be adjusted for use during a storm or a hurricane.

The controller data storage can also have controller computer instructions for opening or closing the fittings after sensed pressure in the access channels has been compared to the preset pressure limits. The sensed pressure can be compared to the preset pressure limits in order to balance the pressures according to specifications or other parameters defined by a user, by the weather, or by an emergency situation. The controller can provide continuous 24 hours a day, 7 days a week monitoring and control from a remote location which can be many miles from the tensioner system.

The controller can be critical for situations when all people must be evacuated from a floating platform or other structure because of weather conditions, as the well still needs continuous monitoring and controlling so that the well does not break apart in high seas.

Embodiments of the controller have the ability to remotely adjust the tension on the casing of the well as storms swell and increase, as well as when storms abate in changing dangerous weather conditions, which allows rigs to prevent breakage in high seas.

The controller processor can communicate with a network for remote controlling pressure in one or both of the channels using a client device. The client device, such as a cellular phone or lap top, can have client device computer instructions for presenting an executive dashboard to a user that allows for simultaneous and continuous monitoring of a plurality of self contained dual pressure cylinders.

The controller can have computer instructions for providing an alarm to a client device connected to the network when one or more of the dual pressure cylinders pressure falls below or exceeds a preset pressure limit stored in the data storage of the controller.

Each dual pressure cylinder can include a high pressure outer barrel and a low pressure inner barrel. Each cylinder can be made from a high strength low carbon alloy, a composite of carbon fiber, a synthetic fiber with an epoxy resin, or any other suitable material.

The high pressure outer barrel can be made from a high strength low carbon alloy, a composite of carbon fiber, a composite of a synthetic fiber with an epoxy resin, or another suitable material. The low pressure inner barrel can be made from a material different from the high pressure barrel, or can be made from the same material as the high pressure inner barrel. Use of two different materials allows the dual pressure cylinder to have strength with low weight, or high impact strength with flexibility, as each material gives rise to a different physical property.

In embodiments, each outer barrel can be threaded to each respective inner barrel.

The high pressure gas channel can have a diameter that is from about 10 percent to about 24 percent smaller than the diameter of the low pressure fluid channel.

The tensioner system usable in the method can include a first guide post secured to a first side of the tensioner table and a second guide post disposed on a second side of the tensioner table. The first side is opposite the second side, and the plurality of dual pressure cylinders can be disposed between the first and second guide posts.

A tension joint with a tension ring can connect to the top side of the tensioner table. The tension joint can engage wellhead equipment.

An umbilical connection on the tensioner table can secure an umbilical that communicates between the tensioner and the controller.

The tensioner system can have a housing having a housing top end with a first guide post holder and a second guide post holder. The tensioner system can have at least one dual pressure cylinder connection for each of the plurality of dual pressure cylinders in the housing. The housing can have a housing bottom cap connected to a conductor with a flange connection. The flange connection can surround a riser.

Between 6 dual pressure cylinders to 8 dual pressure cylinders can be secured within the housing.

The tensioner table can rest on the load buckets. Each load bucket can engage a hollow rod of a dual pressure cylinder. The tensioner table can permit continual operation of wellhead equipment, simultaneously while the individual dual pressure cylinders are removed.

The housing bottom cap can slope with a grade appropriate to allow drainage. The slope of the bottom cap can be from about 2 degrees to about 45 degrees. The housing can have an outer sheath disposed between the housing top end and the housing bottom cap for protecting the dual pressure cylinders from greenwater and other materials.

The tensioner system can have dual pressure cylinder connections for each of the dual pressure cylinders to fit through holes formed in the tensioner table. Each dual pressure cylinder connection can secure to a load bucket.

A centralizer can be used to maintain all of the self contained dual pressure cylinders in an equidistant orientation around the conductor.

A flexible insert can be used in the tensioner system that enables at least one of the self contained dual pressure cylinders to be lowered or raised for maintenance while providing a rigid lateral support to each cylinder without requiring the use of rigid mechanical fasteners or rigid connectors.

Embodiments can include a method for tensioning casing from an oil or natural gas well to a floating structure by installing a plurality of dual pressure cylinders to a tensionser table.

Another step can involve orienting the tensioner table with the plurality of dual pressure cylinders between a first guide post secured to on a first side of the tensioner table and a second guide post disposed on a second side of the tensioner table.

Next, a tension joint with a tension ring can be connected to the tensioner table. The tension joint can engage wellhead equipment.

The next step can involve connecting an umbilical to the tensioner table, wherein the umbilical communicates between the tensioner table and a controller.

Another step can include securing a housing having a plurality of pistons to the first and second guide posts and connecting each of the plurality of dual pressure cylinders to one of the pistons around a conductor.

Next, fluid can be allowed to drain through a housing bottom cap. The housing bottom cap can be connected to a riser.

A subsequent step can involve pressurizing each of the dual pressure cylinders to a preset pressure limit and monitoring the pressure of each of the dual pressure cylinders simultaneously.

Turning now to FIGS. 1A-1D, the dual pressure cylinder 8 is made from a high pressure outer barrel 10 surrounding a high pressure inner barrel 12 to form a high pressure gas channel 14.

As an example, the high pressure outer barrel 10 can be made of steel and have a thickness from about ¾ inches to about 2 inches, and the high pressure gas channel 14 can contain a high pressure gas, such as nitrogen at a pressure from about 500 psi to about 3000 psi. The high pressure inner barrel 12 can be made of cold rolled steel.

The high pressure outer barrel 10 can be coated with thermal sprayed aluminum or with marine paint with inorganic zinc primer as a base for cathodic protection. Similarly, the high pressure outer barrel can have a sacrificial anode for enhanced cathodic protection, which lowers maintenance issues.

The high pressure gas channel 14 between the high pressure inner barrel 12 and the high pressure outer barrel 10 can have a diameter from about 1 inch to about 4 inches.

The high pressure inner barrel 12 can be made of a different substance from the high pressure outer barrel to allow two different physical properties to be imparted to the gas channel.

The high pressure inner barrel 12 provides a space for a moveable hollow rod 30 to move up and down between the high pressure inner barrel 12 and a low pressure inner barrel 18.

The moveable hollow rod 30 can have a variable diameter depending on the load that needs to be supported by the moveable hollow rod from a tensioner table.

In an example, the high pressure inner barrel 12 and the low pressure inner barrel 18 can have a thickness from about 1 inch to about 2 inches, however the thickness is variable for larger or smaller loads.

Adjacent to the high pressure outer barrel 10 is a low pressure outer barrel 16 surrounding the low pressure inner barrel 18 to form a low pressure gas channel 20. The high pressure inner barrel 12 and the high pressure outer barrel 10 are disposed in sequence with the corresponding low pressure inner barrel 18 and the low pressure outer barrel 16.

Like the high pressure outer barrel, the low pressure outer barrel can be constructed from a material that is more impact resistant than the corresponding high pressure inner barrel and the low pressure inner barrel.

In embodiments, the high pressure outer barrel or the low pressure outer barrel can have a thickness greater than the corresponding high pressure inner barrel or low pressure inner barrel. The larger the diameter of the high pressure outer barrel or low pressure outer barrel, the more wall thickness is required to support the load.

In embodiments, the high pressure outer barrel and the low pressure outer barrel can have the same thickness, as can the high pressure inner barrel and the low pressure inner barrel. It can be noted that in embodiments, the high pressure inner barrel and the low pressure inner barrel can be about 50 percent thinner than the corresponding high pressure outer barrel and low pressure outer barrel.

A high pressure gas port 22 is connected to the high pressure gas channel 14. The high pressure gas port 22 can receive compressed gas. In embodiments, gas and gas/liquid reservoirs can connect to the ports. A high pressure gas reservoir 26 can connect to the high pressure gas port 22. The high pressure gas reservoir 26 acts as a high pressure accumulator. A low pressure gas reservoir 28 simultaneously acts as a low pressure accumulator, and can be in fluid communication with a low pressure fluid port 17.

The moveable hollow rod 30 has a hollow chamber 31 for receiving the high pressure gas. The hollow chamber 31 is shown extending the length of the moveable hollow rod 30 for receiving the high pressure gas to provide additional volume to the tensioner system usable in the method, which increases tensioner stiffness without need for external bottles of gas.

The moveable hollow rod 30 slides within the high pressure inner barrel 12 and the low pressure inner barrel 18. The moveable hollow rod has a first end 32 for engaging a tensioner system, such as a tensioner table attached to wellhead equipment on a floating vessel or similar floating platform.

Figure 3A:
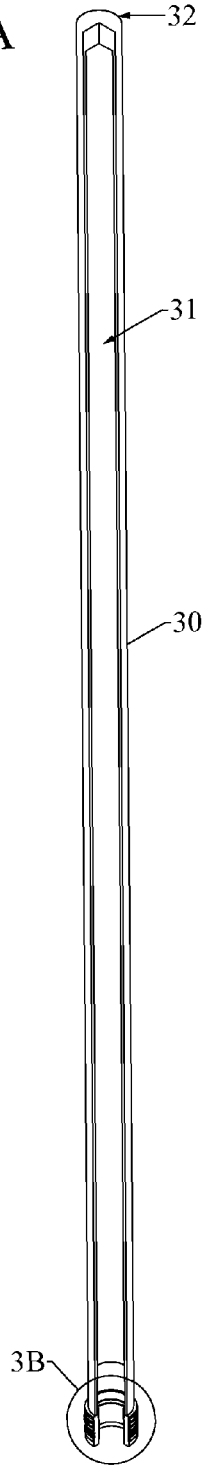
FIGS. 3A-3B show a detailed view of a moveable hollow rod.
Figure 3B:
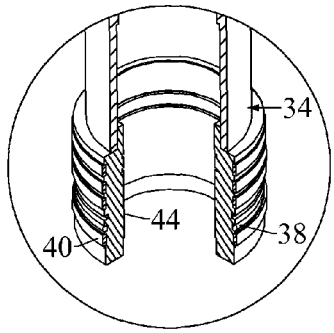

A dual pressure capture plate 36 with moveable rod seals 38 and moveable rod wear bands 40, which is shown in more detail in FIGS. 3A-3B, moveably seals the moveable hollow rod inside the high pressure inner barrel or the low pressure inner barrel.

The dual pressure capture plate 36 can be made of a low carbon alloy steel, such as a plate from about 2 inches to about 4 inches thick steel. The dual pressure capture plate enables the dual pressure cylinder to be attached to a housing for supporting a multitude of dual pressure cylinders. The dual capture plate provides access for charging and venting the dual pressure cylinders.

The moveable rod seals 38 can be made from polycarbonate, Teflon™, polyamide, or elastomeric material. The moveable rod seals can be circular bands with a thickness adequate to provide a sealing condition between the dual pressure capture plate and the moveable hollow rod.

A piston 42 is shown fastened to a second end 34 of the moveable hollow rod opposite the tensioner system thereby forming the dual pressure self contained cylinder adapted to provide strokes from about 6 feet to about 35 feet in length.

The piston 42 provides a seal between the high pressure side and the low pressure side of the inner barrels. In an embodiment, the piston can be a solid cylindrical ring. A plug 555 can seal a piston drain port.

FIGS. 1A-1D also show a high pressure compression area 25.

Figure 2A:
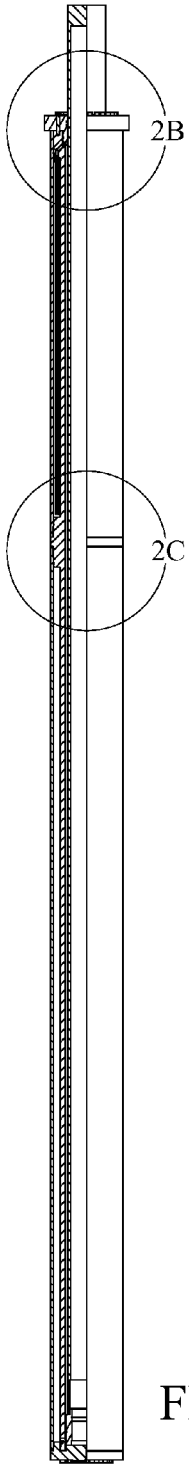
FIGS. 2A-2B show a side view of a dual pressure cylinder.
Figure 2B:
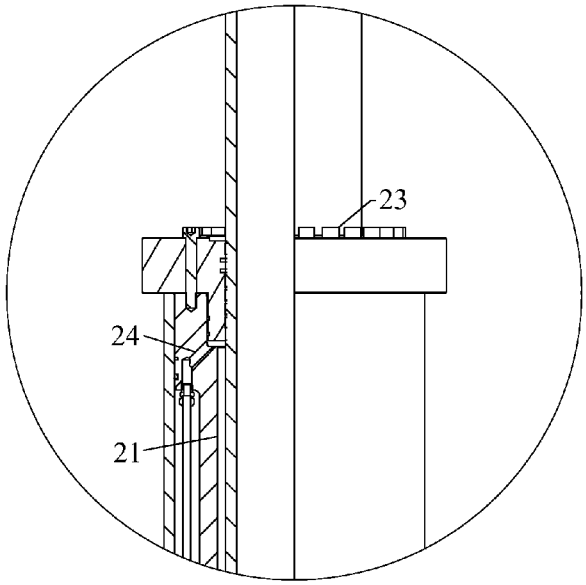
Figure 2C:
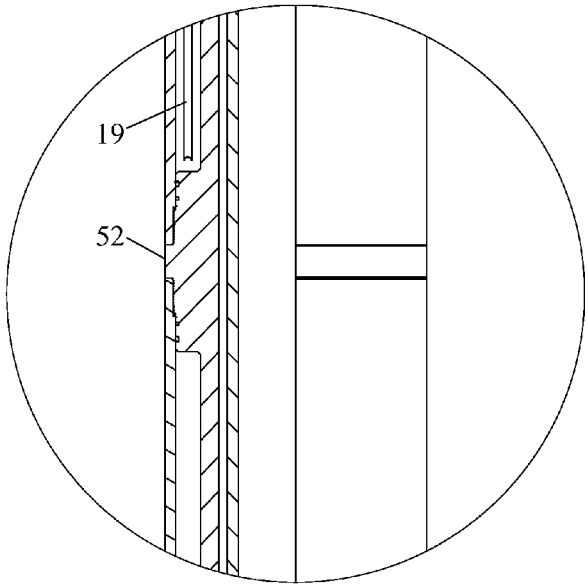

FIGS. 2A-2B show the low pressure port 24 that connects to the low pressure gas channel. The low pressure port receives compressed gas and liquid at a pressure. The low pressure gas reservoir can also connect to the low pressure gas port.

The low pressure/high pressure separator 52 can be built into the outside of the high pressure inner barrel and on the outside of the low pressure inner barrel. The low pressure/high pressure separator can be made of the same material as the high pressure inner barrel and low pressure inner barrel. The low pressure/high pressure separator can be a wall, and it can have the same thickness to seal the high pressure inner barrel and low pressure inner barrel with the corresponding high pressure outer barrel and low pressure outer barrel.

The low pressure/high pressure separator is static. Static as used herein referees to the low pressure/high pressure separator that does not move to the inside of the outer barrel.

FIGS. 2A-2B also show the low pressure compression area 21 of the dual pressure cylinder and a high pressure regulatory access port 23. A cross section of the separator 52 described above is shown as well as a low pressure standpipe 19. The low pressure standpipe allows liquid from the low pressure inner barrel to have a means to transfer back and forth from the low pressure outer barrel through the low pressure port.

FIGS. 3A-3B show the moveable hollow rod 30 with the hollow chamber 31 and the first end 32 of the moveable hollow rod. Also shown is a piston body 44 with the moveable rod seals 38 and the moveable rod wear bands 40. This Figure also shows the second end 34 of the moveable hollow rod adjacent the piston body 44.

FIGS. 4A-4C show the low pressure/high pressure separator 52 and the low pressure elastomeric seal 48 adjacent to the low pressure/high pressure separator.

A high pressure elastomeric seal 50 is shown disposed on the opposite side from to the low pressure/high pressure separator 52. The low pressure/high pressure separator provides a solid wall. Additionally, the low pressure gas reservoir 28 is shown adjacent to the low pressure elastomeric seal 48, and the high pressure gas reservoir 26 is shown on the opposite side of the high pressure elastomeric seal 50. The low pressure standpipe 19 is also shown.

The low pressure/high pressure separator 52 provides a non-deforming separation between the high pressure gas channel and the low pressure gas channel, as well as a non-deforming separation between the low pressure compression area and the high pressure compression area.

Figure 5A:
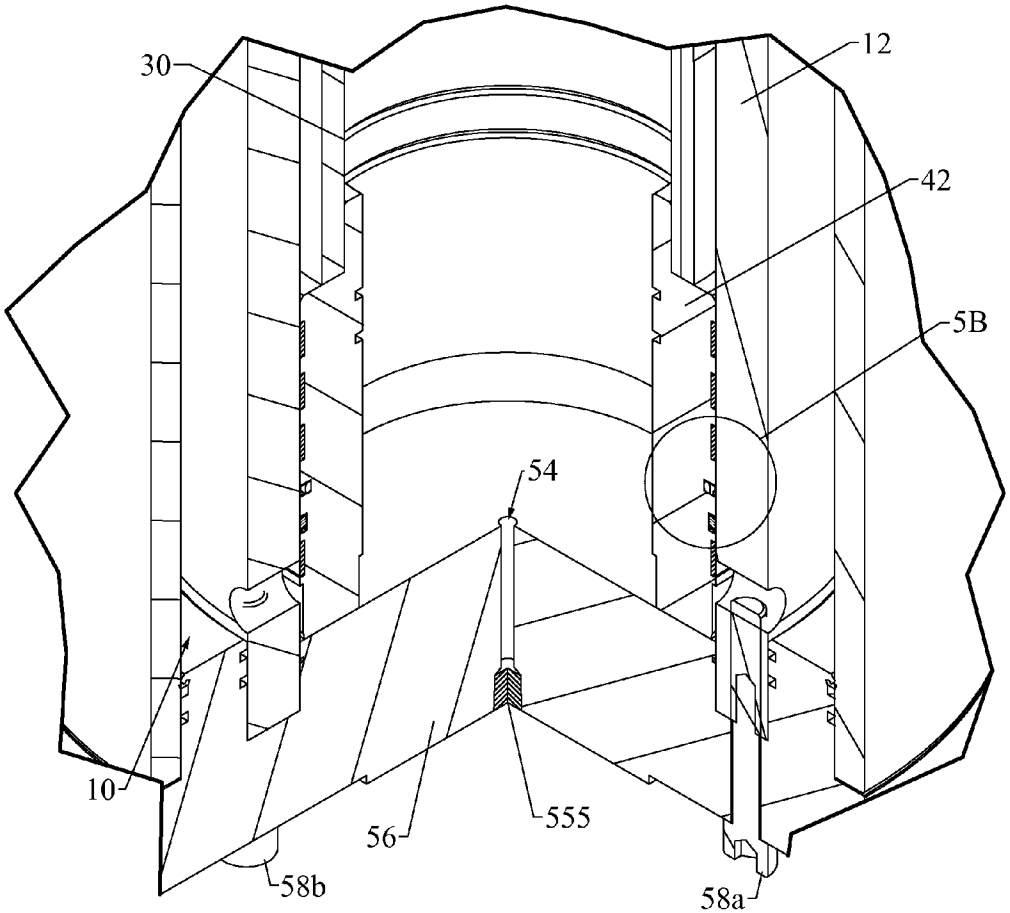
FIGS. 5A-5B show a detailed view of a piston portion of a dual pressure cylinder.
Figure 5B:
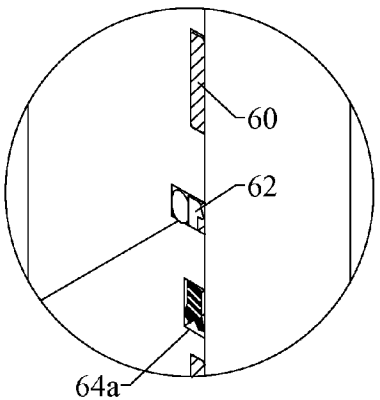

FIGS. 5A-5B show a detail of the piston 42 attached to the moveable hollow rod 30. Also shown is the high pressure outer barrel 10, a piston drain port 54, a piston end cap 56, and a plurality of piston fasteners 58*a*, 58*b*. Piston fastener 58*a* is shown holding the piston end cap 56 to the high pressure inner barrel 12. A piston wear band 60 is shown adjacent and in tandem with a piston seal 62.

Multiple piston wear bands and multiple piston seals can be used. Similarly, a primary piston seal and a secondary piston seal can be formed, each within a piston seal groove 64*a*.

The piston drain port 54 operates with a plug 555 disposed therein.

Figure 6:
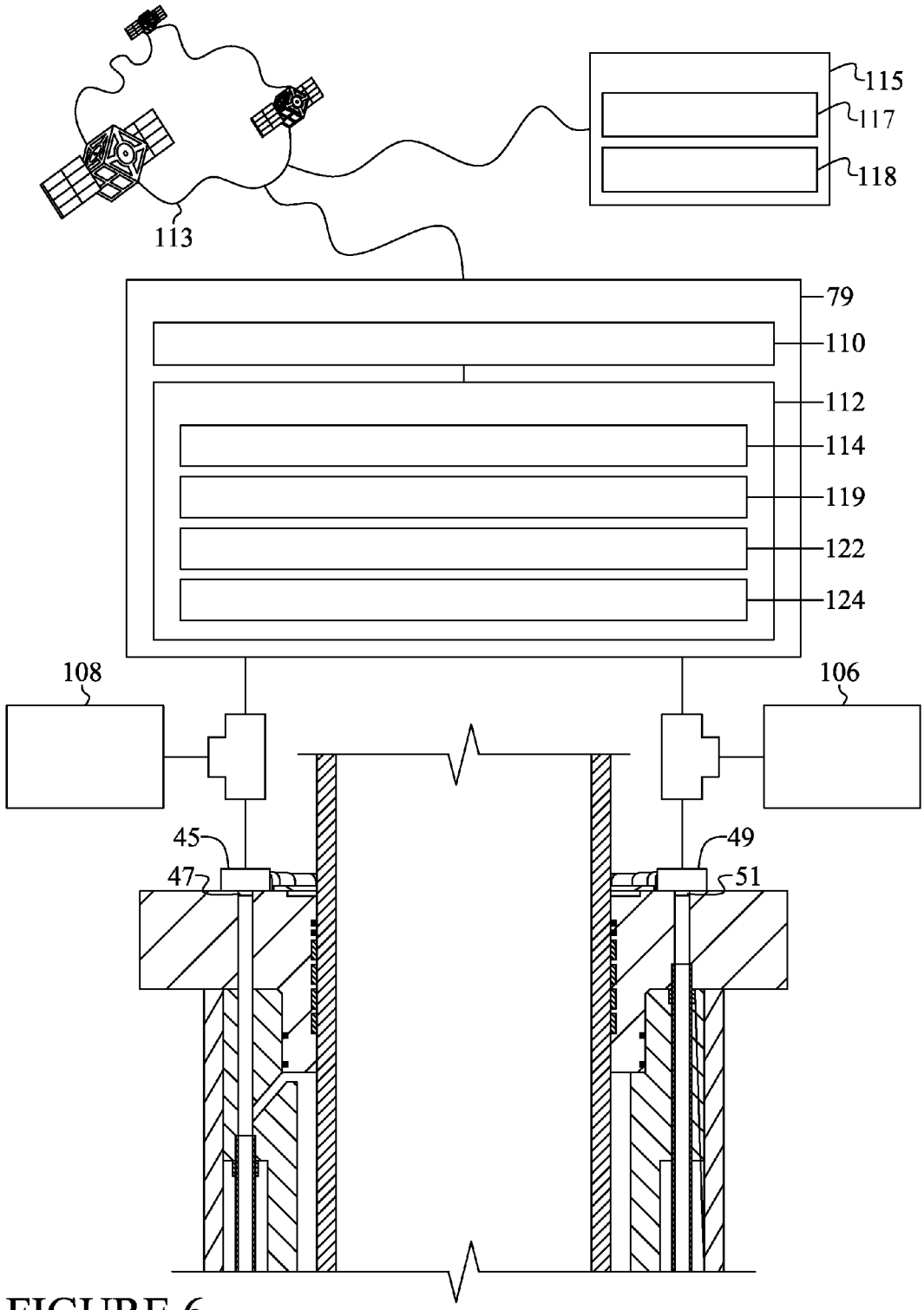
FIG. 6 is a detailed view of a top cutaway portion of a dual pressure cylinder with a controller.

FIG. 6 shows an embodiment with the top of the dual pressure cylinder with a low pressure access port 45 and a high pressure access port 49. Attached to the low pressure access port is a low pressure closable fitting 47. Attached to the high pressure access port is a high pressure closable fitting 51.

A high pressure sensor 106 is connected to the high pressure access port 49 and to a controller 79. A low pressure sensor 108 is connected to the low pressure access port 45 and to the controller 79.

In an embodiment, both of the high pressure access port and low pressure access port can be different ports from the fluid pathway and gas ports used to control the cylinders.

It can be contemplated that the controller has a controller processor 110 connected to controller data storage 112 with controller computer instructions 114 for opening or closing the fittings.

A client device 115 with client device computer instructions 118 for presenting an executive dashboard to allow simultaneous monitoring of a plurality of self contained dual pressure cylinders. The client device is shown in communication with the controller 79 through a network 113. The client device 115 can present the executive dashboard 117.

The controller data storage 112 can have controller computer instructions 122 to enable the storing of preset pressure limits for a tensioner system. The controller data storage can also have controller computer instructions 124 to compare sensed pressures to the preset pressure limits.

The controller data storage 112 can further have controller computer instructions 119 for providing an alarm to a client device when one or more of the dual pressure cylinders pressure falls below or exceeds a preset pressure limit.

Based on a comparison of the pressures of the dual pressure cylinders to the preset pressure limits stored in the data storage of the controller, the controller can determine whether the pressures are above or below the preset limits, can provide an alarm to a user, or can modify the pressures in the channels to conform to the preset limits.

Figure 7:
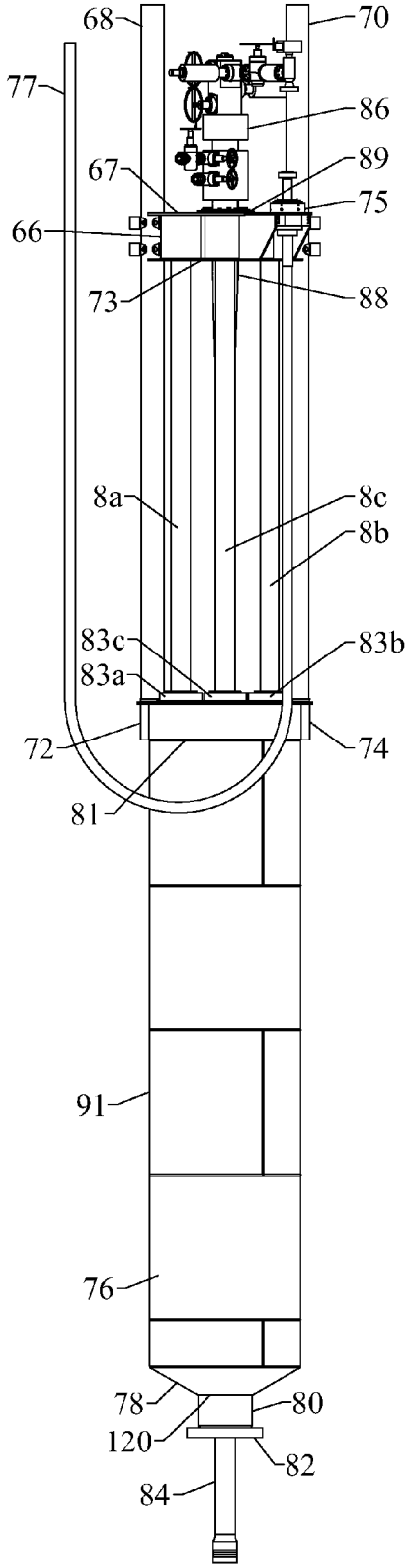
FIG. 7 is a side view of the tensioner system.

FIG. 7 is a side view of the tensioner system usable in the method having a plurality of hydraulic dual pressure cylinders 8*a*, 8*b*, 8*c*. Also shown is a tensioner table 66 with a top side 67 and a bottom side 73.

Wellhead equipment 86, such as valving, ports, seals, and pipe, is secured to the top side of the tensioner cable. Also on the top side is an umbilical connection 75, which engages an umbilical 77 for providing communication and signals to another location.

A tension ring 89 is shown secured to the top side 67 between the top side and the wellhead equipment 86. The tensioner table bottom side 73 has a tension joint 88 secured to it.

A first guide post 68, which extends above and below the tensioner table 66, is shown secured to one side of the tensioner table. The first guide post is parallel to a second guide post 70, which also extends above and below the tensioner table 66 to provide support to a housing 76 that supports the cylinders for tensioning.

The first guide post 68 is supported by and attached to a first guide post holder 72, which secures to the top of the housing 76. The second guide post 70 is supported by and attaches to the second guide post holder 74.

Cylinder connections 83*a*, 83*b*, 83*c* are depicted on top of the housing 76 and between the first guide post holder 72 and the second guide post holder 74. The cylinder connections 83*a*, 83*b*, 83*c* are on the top end 81 of the housing 76. In this embodiment, the hydraulic dual pressure cylinders 8*a*, 8*b*, 8*c* with cylinder connections 83*a*, 83*b*, 83*c* are positioned in a circle, equidistantly disposed from each other.

FIG. 7 also shows the housing 76 having an outer sheath 91, which can be used to protect the hydraulic dual pressure cylinders from greenwater during a storm, such as a 100 year storm.

On an end of the housing 76 opposite the first guide post holder 72 and the second guide post holder 74, is a bottom cap 78 that slopes towards a central exit port 120. The sloping sides of the bottom cap 78 come together and provide a smaller diameter central exit port 120 than the diameter of the housing 76. A conductor 80 extends from the smaller diameter of the central exit port 120 to a flange connection 82 which meets a riser 84 from the oil well equipment.

Figure 8:
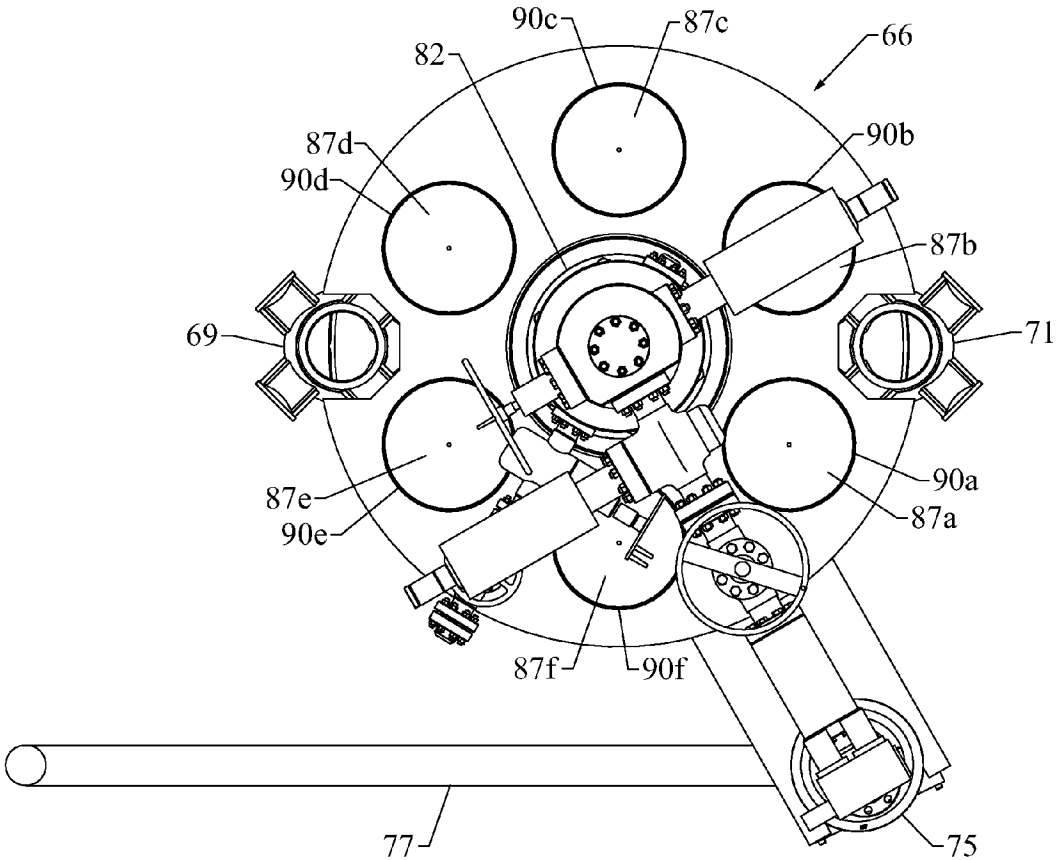
FIG. 8 is a top view of a tensioner table.

FIG. 8 is a top view of a tensioner table 66 with guide rods. A first side 69 of the tensioner table and a second side 71 of the tensioner table are shown. The flange connection 82 is depicted for connections to the oil well equipment.

In this view the load buckets 87*a*, 87*b*, 87*c*, 87*d*, 87*e*, 87*f* are shown over holes 90*a*, 90*b*, 90*c*, 90*d*, 90*e*, 90*f*. The load buckets can engage and support the hydraulic dual pressure cylinders.

The umbilical connection 75 is also viewable in this Figure, and is shown attached to the umbilical 77.

Figure 9:
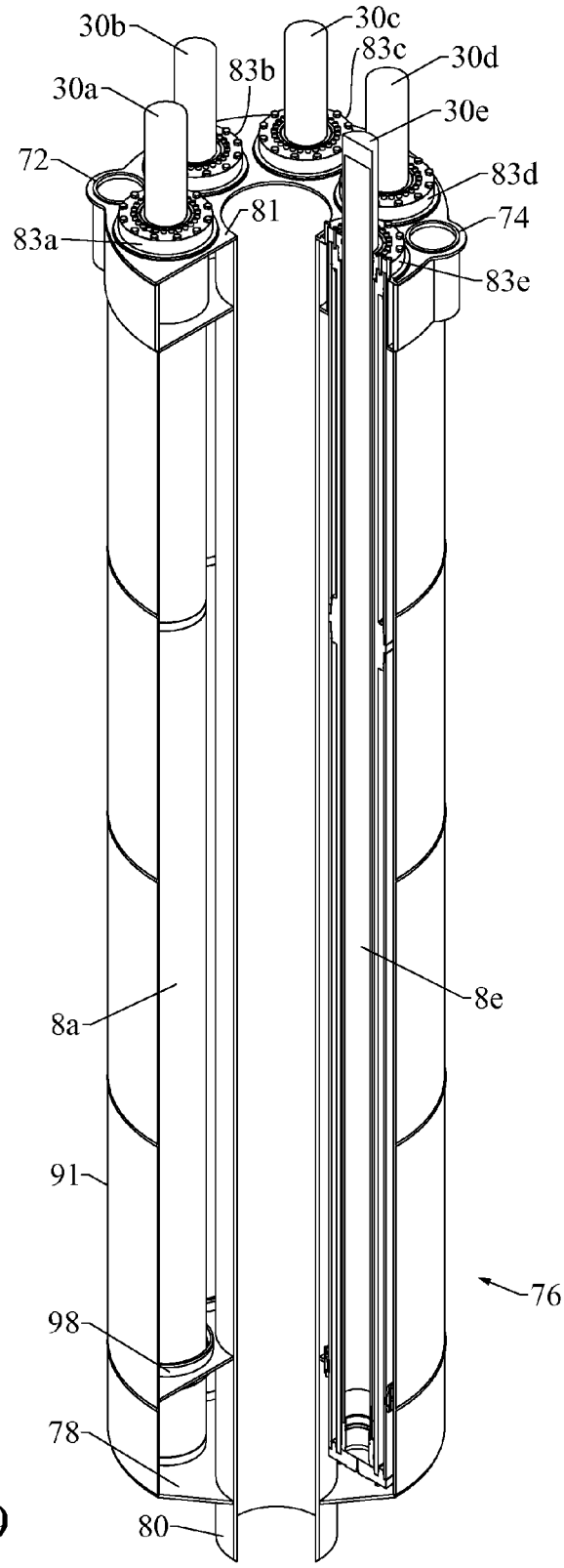
FIG. 9 depicts an isometric view of a tensioner system.

FIG. 9 shows a cutaway of an isometric view of the tensioner system usable in the method. This view shows one and one half of two hydraulic dual pressure cylinders 8*a*, and half of 8*e* within the housing 76 with the outer sheath 91. At the top of the housing 76 is the first guide post holder 72 and second guide post holder 74, as well as four of the cylinder connections 83*a*, 83*b*, 83*c* 83*d*, 83*e*.

The housing 76 includes the outer sheath 91 connected to the top end 81 and the bottom cap 78.

The moveable hollow rods 30*a*, 30*b*, 30*c*, 30*d*, and half of 30*e* can be seen engaging the housing 76 and extending from the cylinder connections 83*a*, 83*b*, 83*c* 83*d*, 83*e*.

A centralizer 98 and the conductor 80 are shown also shown in this Figure at the bottom of the housing 76.

Figure 10:
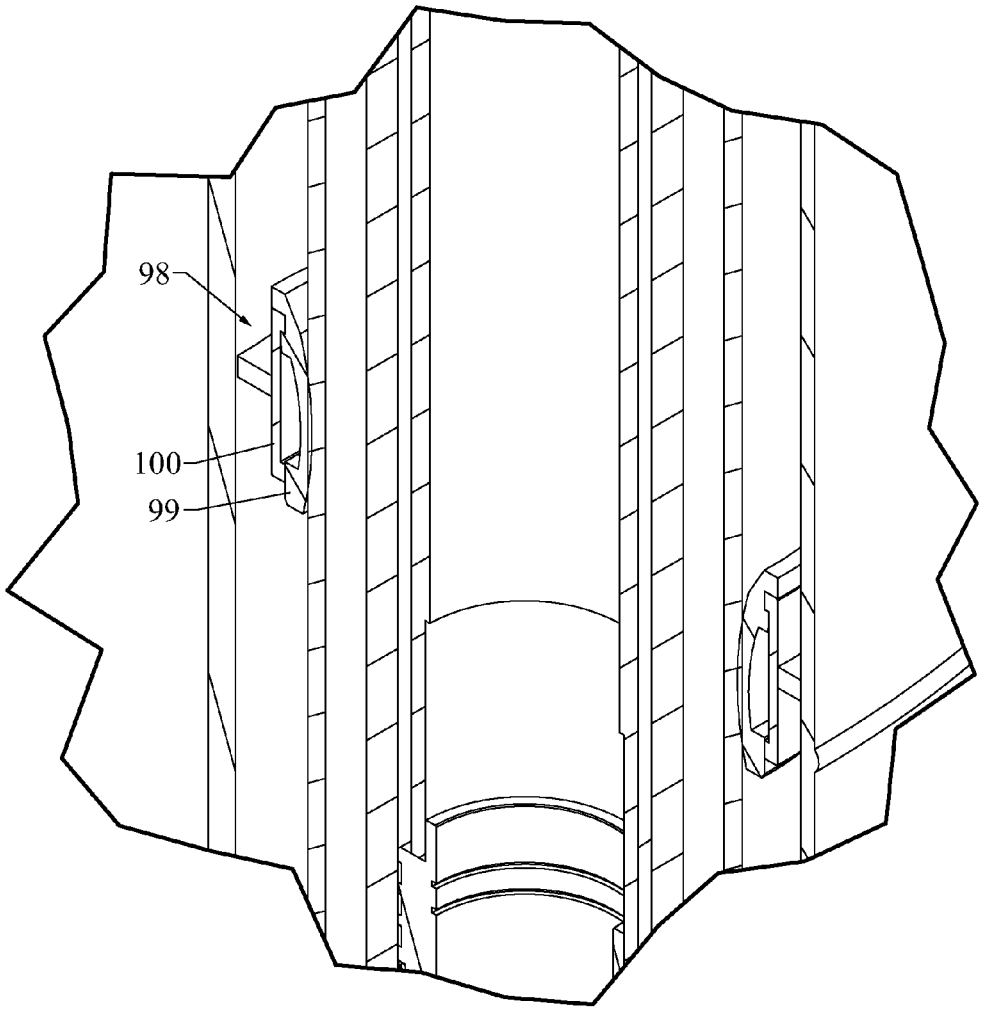
FIG. 10 depicts a detail of the centralizer.

FIG. 10 shows a detail of the centralizer 98 with a flexible insert 99 and a support back 100. Each connection for each hydraulic dual pressure cylinder can have a centralizer.

Figure 11:
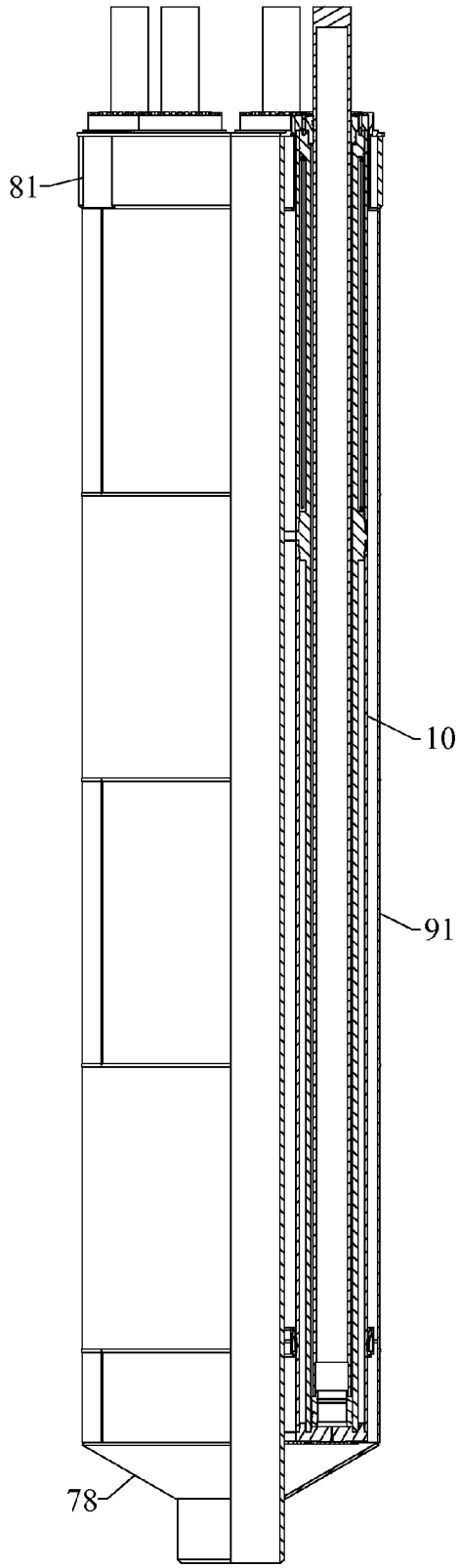
FIG. 11 is a side view of the tensioner system with a portion cut away.

FIG. 11 is a side view of the tensioner system usable in the method with a portion cut away. This view has a cut away of the outer sheath 91 so that the operation of the pistons can be understood. The high pressure outer barrel 10 is shown with the top end 81 of the housing 76 and the bottom cap 78.

Figure 12A:
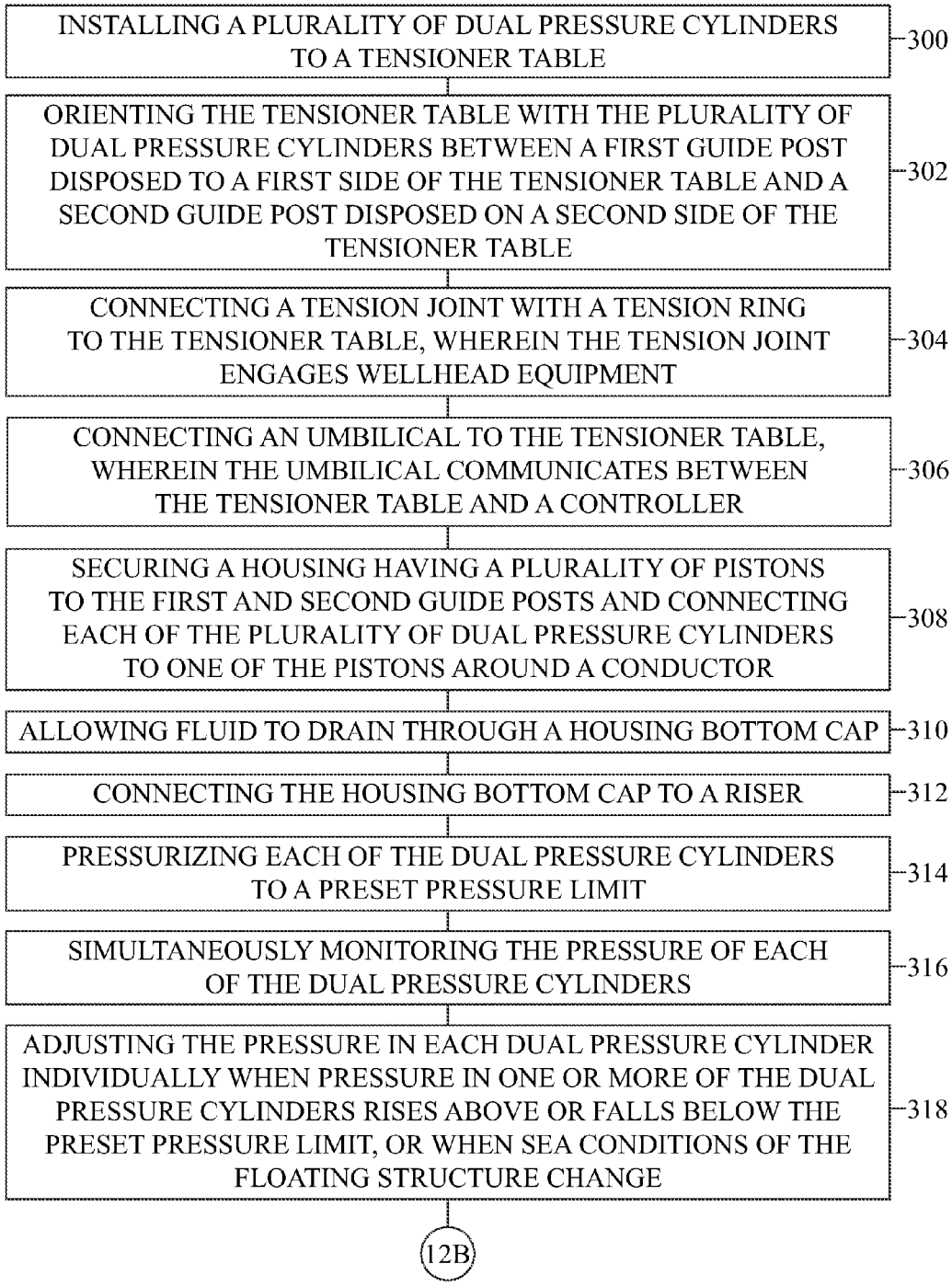
FIG. 12A is a flow chart of an embodiment of the dual pressure tensioning method.

FIG. 12A shows a flow chart of an embodiment of a method for tensioning casing from an oil or natural gas well to a floating structure.

A first step 300 can include installing a plurality of dual pressure cylinders to a tensioner table.

Next, step 302 can include orienting the tensioner table with the plurality of dual pressure cylinders between a first guide post disposed to a first side of the tensioner table and a second guide post disposed on a second side of the tensioner table.

Step 304 can include connecting a tension joint with a tension ring to the tensioner table, wherein the tension joint engages wellhead equipment.

Step 306 can include connecting an umbilical to the tensioner table, wherein the umbilical communicates between the tensioner table and a controller.

Step 308 can include securing a housing having a plurality of pistons to the first and second guide posts and connecting each of the plurality of dual pressure cylinders to one of the pistons around a conductor.

Step 310 can include allowing fluid to drain through a housing bottom cap.

Next, step 312 can include connecting the housing bottom cap to a riser.

Step 314 can include pressurizing each of the dual pressure cylinders to a preset pressure limit.

Step 316 can include simultaneously monitoring the pressure of each of the dual pressure cylinders.

Next, step 318 can include adjusting the pressure in each dual pressure cylinder individually when pressure in one or more of the dual pressure cylinders rises above or falls below the preset pressure limit, or when sea conditions of the floating structure change.

Figure 12B:
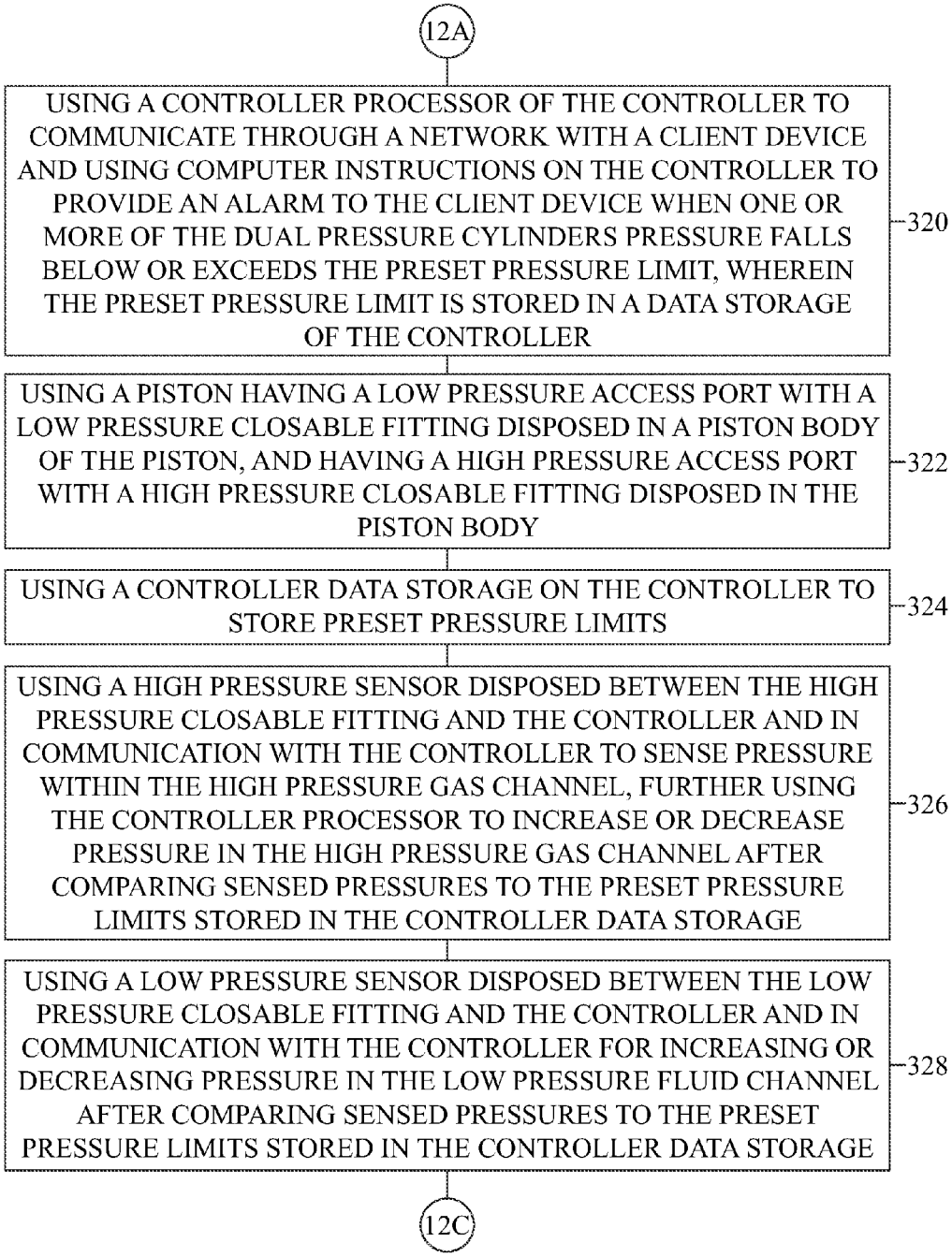
FIG. 12B is a continuation of the flow chart of FIG. 12A.

FIG. 12B shows a continuation of the flow chart shown in FIG. 12A, wherein step 320 can follow step 318. Step 320 can include using a controller processor of the controller to communicate through a network with a client device and using computer instructions on the controller to provide an alarm to the client device when one or more of the dual pressure cylinders pressure falls below or exceeds the preset pressure limit, wherein the preset pressure limit is stored in a data storage of the controller.

Another step 322 can include using a piston having a low pressure access port with a low pressure closable fitting disposed in a piston body of the piston, and having a high pressure access port with a high pressure closable fitting disposed in the piston body.

Step 324 can include using a controller data storage on the controller to store preset pressure limits.

Step 326 can include using a high pressure sensor disposed between the high pressure closable fitting and the controller and in communication with the controller to sense pressure within the high pressure gas channel, further using the controller processor to increase or decrease pressure in the high pressure gas channel after comparing sensed pressures to the preset pressure limits stored in the controller data storage.

Next, step 328 can include using a low pressure sensor disposed between the low pressure closable fitting and the controller and in communication with the controller for increasing or decreasing pressure in the low pressure fluid channel after comparing sensed pressures to the preset pressure limits stored in the controller data storage.

Figure 12C:
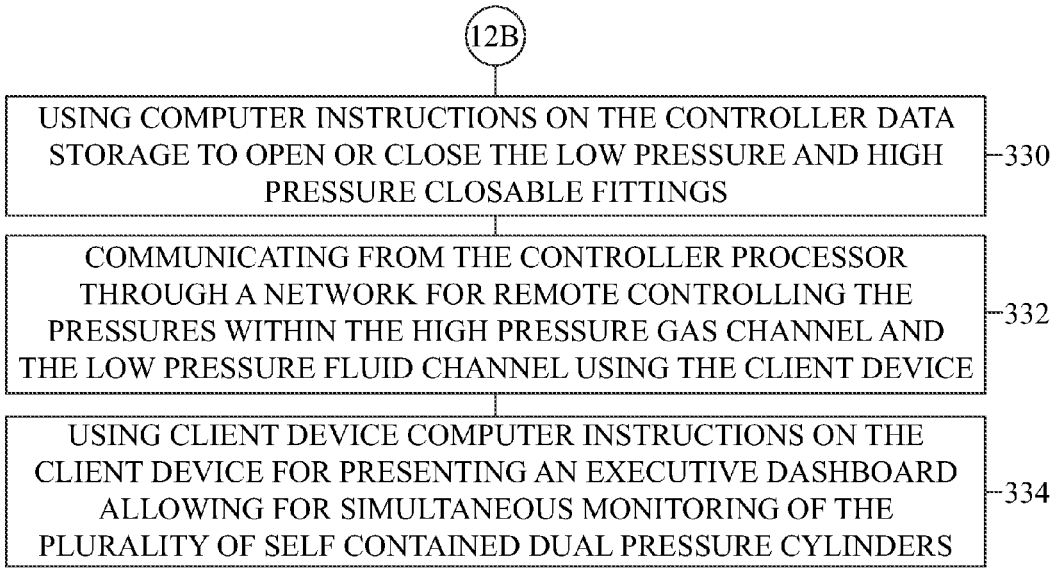
FIG. 12C is a continuation of the flow chart of FIG. 12B.

FIG. 12C is a continuation of the flow chart shown in FIG. 12B, wherein step 330 can follow step 328. Step 330 can include using computer instructions on the controller data storage to open or close the low pressure and high pressure closable fittings.

Step 332 can include communicating from the controller processor through a network for remote controlling the pressures within the high pressure gas channel and the low pressure fluid channel using the client device.

Step 334 can include using client device computer instructions on the client device for presenting an executive dashboard allowing for simultaneous monitoring of the plurality of self contained dual pressure cylinders.

While these embodiments have been described with emphasis on the embodiments, it should be understood that within the scope of the appended claims, the embodiments might be practiced other than as specifically described herein.

What is claimed is:

1. A method for tensioning casing from an oil or natural gas well to a floating structure comprising:

a. installing a plurality of dual pressure cylinders to a tensioner table, wherein the tensioner table has a plurality of load buckets, wherein each load bucket receives an end of one of the dual pressure cylinders, further wherein each dual pressure cylinder comprises:

(i) a high pressure outer barrel surrounding an inner barrel, forming a high pressure gas reservoir in communication with a high pressure gas channel, wherein the high pressure gas reservoir is a space formed between the high pressure outer barrel and the inner barrel;

(ii) a low pressure outer barrel surrounding the inner barrel, forming a low pressure gas reservoir in communication with a low pressure fluid channel, wherein the low pressure outer barrel adjoins the high pressure outer barrel, wherein the low pressure gas reservoir is a space formed between the low pressure outer barrel and the inner barrel, wherein the low pressure fluid channel is connected to a low pressure fluid port, and wherein the low pressure fluid port comprises a low pressure compression area;

(iii) a hollow rod movably disposed within the inner barrel, wherein the hollow rod has a hollow rod first end for engaging one of the load buckets of the tensioner table, and further wherein the hollow rod has a chamber which is fluidly connected to the high pressure gas reservoir through the high pressure gas channel enabling the hollow rod to support a load;

(iv) a dual pressure capture plate for sealing the hollow rod moveably inside the inner barrel, wherein the hollow rod has moveable rod wear bands;

(v) a piston on a hollow rod second end opposite the tensioner table, forming a self contained dual pressure cylinder; and (vi) a low pressure seal adjacent a low pressure/high pressure separator and a high pressure seal adjacent the low pressure/high pressure separator, wherein the low pressure/high pressure separator provides a separation between the high pressure gas reservoir and the low pressure gas reservoir, and wherein the low pressure/high pressure separator is static and does not engage the hollow rod;

b. orienting the tensioner table with the plurality of dual pressure cylinders between a first guide post disposed to a first side of the tensioner table and a second guide post disposed on a second side of the tensioner table, wherein the first side is opposite the second side, further wherein the plurality of dual pressure cylinders are disposed between the first and the second guide posts;

c. connecting a tension joint with a tension ring to the tensioner table, wherein the tension joint engages wellhead equipment;

d. connecting an umbilical to the tensioner table, wherein the umbilical communicates between the tensioner table and a controller;

e. securing a housing having a plurality of pistons to the first and second guide posts and connecting each of the plurality of dual pressure cylinders to one of the pistons around a conductor;

f. allowing fluid to drain through a housing bottom cap;

g. connecting the housing bottom cap to a riser;

h. pressurizing each of the dual pressure cylinders to a preset pressure limit;

i. simultaneously monitoring the pressure of each of the dual pressure cylinders; and j. adjusting the pressure in each dual pressure cylinder individually when pressure in one or more of the dual pressure cylinders rises above or falls below the preset pressure limit, or when sea conditions of the floating structure change.

2. The method of claim 1, wherein from 6 dual pressure cylinders to 8 dual pressure cylinders are used.

3. The method of claim 1, further comprising the step of resting each load bucket over a hole on the tensioner table.

4. The method of claim 1, further comprising using a dual pressure cylinder connection for supporting each of the dual pressure cylinders, wherein each dual pressure cylinder connection secures to one of the load buckets.

5. The method of claim 1, further comprising the step of using a controller processor of the controller to communicate through a network with a client device, and using computer instructions on the controller to provide an alarm to the client device when one or more of the dual pressure cylinders pressure falls below or exceeds the preset pressure limit, wherein the preset pressure limit is stored in a data storage of the controller.

6. The method of claim 1, further comprising the step of using an outer sheath disposed between a housing top end and the housing bottom cap for protecting the dual pressure cylinders from green water and other materials.

7. The method of claim 1, further comprising using a centralizer to maintain all of the self contained dual pressure cylinders in an equidistant orientation around the conductor.

8. The method of claim 1, further comprising using a flexible insert to enable at least one of the self contained dual pressure cylinders to be lowered or raised for maintenance while providing a rigid lateral support to each self contained dual pressure cylinder without requiring the use of rigid mechanical fasteners or rigid connectors.

9. The method of claim 1, wherein each piston comprises: a piston body with plurality of moveable rod wear bands and a plurality of moveable rod seals for providing a seal between the piston body and the inner barrel.

10. The method of claim 9, further comprising using as part of the piston body:

a. a low pressure access port with a low pressure closable fitting disposed in the piston body;

b. a high pressure access port with a high pressure closable fitting disposed in the piston body, wherein the controller has a controller processor and a controller data storage for storing preset pressure limits; and c. a high pressure sensor disposed between the high pressure closable fitting and the controller and in communication with the controller; wherein the controller increases or decreases pressure in the high pressure gas channel after comparing sensed pressures to the preset pressure limits stored in the controller data storage; further wherein the controller data storage has controller computer instructions for opening or closing the low pressure and high pressure closable fittings.

11. The method of claim 10, further comprising using a low pressure sensor disposed between the low pressure closable fitting and the controller and in communication with the controller for increasing or decreasing pressure in the low pressure fluid channel after comparing sensed pressures to the preset pressure limits stored in the controller data storage.

12. The method of claim 11, further comprising using in each low pressure fluid channel from 20 percent to 70 percent liquid, with the remainder of the low pressure fluid channel having a gas.

13. The method of claim 12, wherein the gas is selected from the group consisting of: nitrogen, air, helium, argon, and combinations thereof.

14. The method of claim 12, wherein the liquid is a member of the group consisting of: a liquid glycol, a hydraulic liquid, a mineral based liquid lubricant, a silicon liquid, a glycol based liquid lubricant, a white oil, a silicon oil, a mineral oil, and combinations thereof.

15. The method of claim 9, wherein the piston comprises a piston drain port, a piston end cap, a plurality of piston end cap fasteners holding the piston end cap to the high pressure inner barrel, at least one piston wear band, at least one piston seal adjacent to the piston wear band, and at least one piston seal groove for containing one of the piston seals.

16. The method of claim 1, wherein the high pressure gas channel in each self contained dual pressure cylinder has a pressure from 100 psi to 3600 psi.

17. The method of claim 1, further comprising using as a high pressure gas in each self contained dual pressure cylinder a member of the group consisting of: nitrogen, air, helium, argon, and combinations thereof.

18. The method of claim 1, further comprising the step of communicating from a controller processor of the controller to a network for remote controlling the pressures within the high pressure gas channel and the low pressure fluid channel using a client device.

19. The method of claim 18, further comprising using client device computer instructions on the client device for presenting an executive dashboard allowing for simultaneous monitoring of the plurality of self contained dual pressure cylinders.

20. The method of claim 1, wherein the high pressure outer barrel and the inner barrel are made from a member of the group consisting of: a high strength low carbon alloy, a composite of carbon fiber, and a synthetic fiber with an epoxy resin, or combination thereof.

21. The method of claim 1, wherein:

a. the high pressure outer barrel is made from a member of the group consisting of: a high strength low carbon alloy, a composite of carbon fiber; a composite of a synthetic fiber with an epoxy resin, or combinations thereof; and b. the inner barrel is made of a material different from the high pressure outer barrel, enabling the dual pressure cylinders to have two different physical properties.

22. The method of claim 1, wherein the high pressure gas channel has a diameter between ten and twenty four percent smaller than the low pressure fluid channel diameter.

23. The method of claim 1, further comprising the step of coating the high pressure outer barrel for cathodic protection with a thermal sprayed aluminum or a marine paint with inorganic zinc primer.

24. The method of claim 1, wherein the low pressure fluid port extends from the low pressure fluid channel to the piston.

* * * * *